United States Patent [19]

Fink et al.

[11] Patent Number: 4,574,693

[45] Date of Patent: Mar. 11, 1986

[54] SEAL PRESS

[76] Inventors: Cameron Fink, Hearthside Pl. 3, London, Ontario, Canada, N5V 3N1; Robert W. Schram, 22 Ullswater Crescent, London, Ontario, Canada, N6G 3Y8; Anthony Gentile, Apt. 200, 390 Princess Ave., London, Ontario, Canada, N6B 2A9

[21] Appl. No.: 696,825

[22] Filed: Jan. 31, 1985

[30] Foreign Application Priority Data

Oct. 23, 1984 [CA] Canada ..... 466147

[51] Int. Cl.[4] ..... B31F 1/07

[52] U.S. Cl. ..... 101/3 SP; 101/28

[58] Field of Search ..... 101/3 SP, 18, 28

[56] References Cited

U.S. PATENT DOCUMENTS

| | | | |
|---|---|---|---|
| 2,142,009 | 1/1937 | Siebert | 101/18 X |
| 2,202,255 | 5/1940 | Jackson et al. | 101/3 SP |
| 2,906,197 | 9/1959 | Priesmeyer | 101/3 SP |
| 3,446,141 | 8/1967 | Gardiner | 101/18 |
| 3,554,122 | 1/1971 | Priesmeyer | 101/3 SP |
| 4,204,468 | 5/1980 | Harrison | 101/3 SP |

FOREIGN PATENT DOCUMENTS

| | | | |
|---|---|---|---|
| 411697 | 6/1934 | United Kingdom | 101/3 SP |

*Primary Examiner*—Edgar S. Burr
*Assistant Examiner*—Tonya Eckstine
*Attorney, Agent, or Firm*—Hirons, Rogers & Scott

[57] ABSTRACT

The invention provides a seal press for use in embossing paper with a desired pattern using a die and a die counter. The seal press includes a housing, a seal set movable in the housing between inner and outer positions, and housing means biasing the seal set into an open position to receive the paper. A lever is pivotally connected to the housing and movable between upper and lower positions. First engagement means is provided between the lever and seal set with the lever and seal set in respective upper and forward positions, the lever being supported by the seal set in these positions to permit operation of the lever to close the seal set and emboss the paper. Also, second engagement means is provided between the lever and the seal set with the lever and seal set in respective lever and rearward positions for storage of the seal press. The seal set is biased towards the outer position and thereby through the second engagement means the lever is biased towards the lower position.

4 Claims, 10 Drawing Figures

SEAL PRESS

This invention relates to seal presses of the kind used to emboss legal and other documents with a notarial certificate and the like, and more particularly to seal sets used in seal presses.

Seal presses are conventionally made from cast iron and have a base supporting a lever which is angled upwardly above the base. The user depresses the lever and this moves a die vertically downwards into engagement with a die counter to emboss paper positioned between them. The permanent handle makes it impossible to stack the seal presses and this is demanding on shelf space in many offices. Further, the seals are heavy and in order to minimize their weight they are made quite narrowly so that they tend to be unstable. As a result, if the user accidentally pushes it to one side it is quite possible to damage the document.

Other models have been made which suffer from similar disadvantages. Usually the die and counter have to be inserted and lined up manually in a very limited space. If they are not set up accurately, then they will not give an even embossing and may even break or become deformed.

For the above reasons, it is desirable to produce a seal press which has a low profile to minimize angular forces which could otherwise cause it to tip, and also to provide a press which will stack on shelves to maximize use of shelf space. It is also desirable to make the seal press light; to minimize the force needed to cause the embossing; and also to provide a structure in which the die and counter seals can be set in the structure and aligned conveniently and independently.

Accordingly, in one of its aspects, a seal press is provided for use in embossing paper with a desired pattern using a die and a die counter. The seal press includes a housing, a seal set movable in the housing between inner and outer positions, and housing means biasing the seal set into an open position to receive the paper. A lever is pivotally connected to the housing and movable between upper and lower positions. First engagement means is provided between the lever and seal set with the lever and seal set in respective upper and forward positions, the lever being supported by the seal set in these positions to permit operation of the lever to close the seal set and emboss the paper. Also, second engagement means is provided between the lever and the seal set with the lever and seal set in respective lower and rearward positions for storage of the seal press. The seal set is biased towards the outer position and thereby through the second engagement means the lever is biased towards the lower position.

According to a second aspect of the invention, a seal set is provided for use in a seal press. The seal set has first and second portions for receiving respectively a die and a die counter and hinge means coupling the first and second portions to one another for movement between an open position in which the die and die counter are held parallel to one another and a closed position in which the die and die counter are in parallel about paper being embossed. At least one of the first and second portions is sufficiently flexible to accommodate rotation of at least one of the die and die counter needed to compensate for the angular movement about the hinge means and to permit the die and die counter to take up their positions in parallel in contact with the paper.

These and other aspects of the invention will be better understood with reference to the drawings in which.

Figure 1:
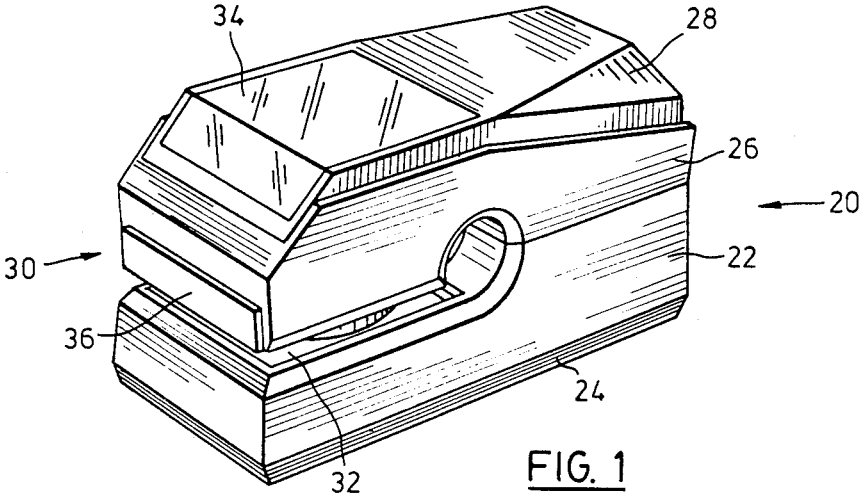
FIG. 1 is a perspective frontal view of a seal press according to the invention.

Reference is made first to FIG. 1 which illustrates a seal press 20 consisting of a lower housing having a shell 22 mounted on a base 24 and supporting an upper shell 26. A lever 28 is mounted pivotally near its front for operating a seal set 30 to emboss paper entered in a slot 32 from the front of the seal press. The handle includes a transparent cover 34 which can be removed to receive a specimen of the embossing done by the seal set for reference purposes.

As will be described, the seal press 20 is used by first elevating the rearward end of the lever 28 which releases the seal set 30 to move forward into an operating position. Once paper is engaged in slot 32, the lever can be moved downwardly to first engage the seal set about the paper and to then cause embossing. Once the user has completed this operation, a front portion 36 of the seal set can be pushed to move the seal set rearwardly and this will release the lever which will then fall into the stored position shown in FIG. 1. Details of these movements will be described with reference to FIGS. 4 to 6.

Figure 2:
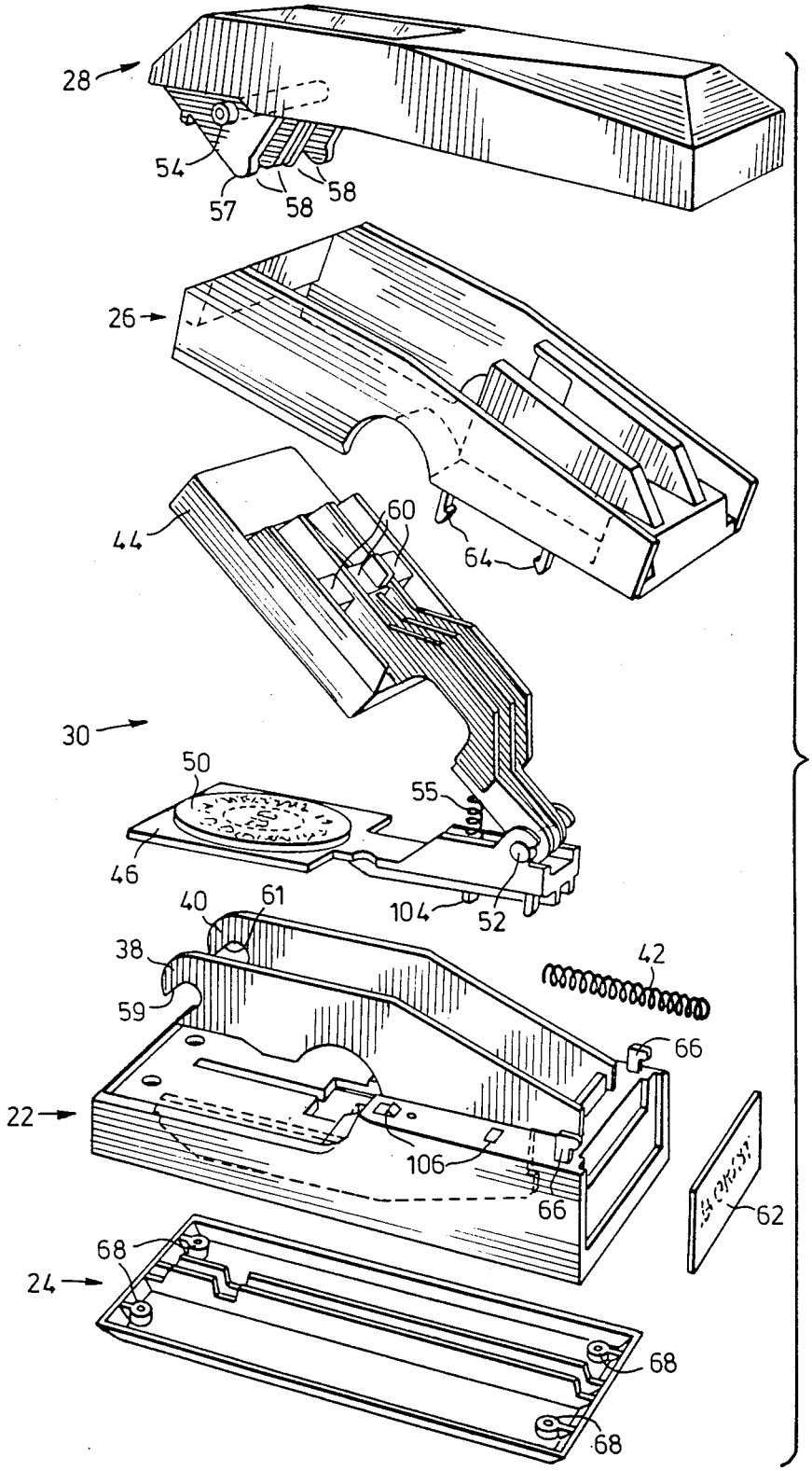
FIG. 2 is an exploded perspective view of the seal press.

Reference is next made to FIG. 2 to describe the major parts of the seal set for a better understanding of these movements.

The base 24 is attached to the underside of the lower shell 22 after a pair of reinforcing elements 38, 40 have been engaged in this shell. These elements are of tempered steel and the shell and base are of any suitable synthetic plastic material, preferably ABS resin. A compression spring 42 is provided for location in the lower shell to bias the seal set outwardly into the operational position. The seal set consists of upper and lower portions 44, 46 which carry respectively die 48 (shown in FIG. 3) and die counter 50. The die and counter are brought together from an open position to cause embossing on the paper by moving the upper portion about a pivot 52. Both portions 44, 46 are preferably of acetal resin whereas the die is of polyetherimide material and the counter is preferably a glass reinforced styrene acrylomitrile material.

The lever 28 has a pivot pin 54 for engagement in upwardly and rearwardly extending slots 59, 61 of the reinforcing elements 38, 40. The pivot is held in position by compression of a spring 55 between the upper and lower portions of the seal set because the upper portion is in engagement with four downwardly extending triangular ribs 58 under the pivot pin 54. These ribs terminate in cam surfaces 57 (one of which is indicated for simplicity) for engagement on follower surfaces 60 (three of which can be seen) of the upper portion 44 to transmit a downward force on the lever from the lever 28 to the die. Upper shell 26 completes the assembly and is positioned under the main part of the lever with the cam surfaces 57 projecting through into engagement with the cam follower surfaces 60.

As also seen in FIG. 2, the seal press can include a name plate or supplier identification plate 62 which slides into position at the back of the lower shell 22 and is trapped there when the upper shell is attached. These shells are connected to one another by hooked pegs 64 (two of which can be seen) on the underside of the upper shell 26 in combination with two upstanding L-shaped elements 66 at the back of the lower shell which engage in suitable openings provided in the upper shell. Similarly, suitable projections are provided on the underside of the shell 22 to engage in four small openings 68 provided in upwardly-facing bosses formed in the base 24.

Figure 3:
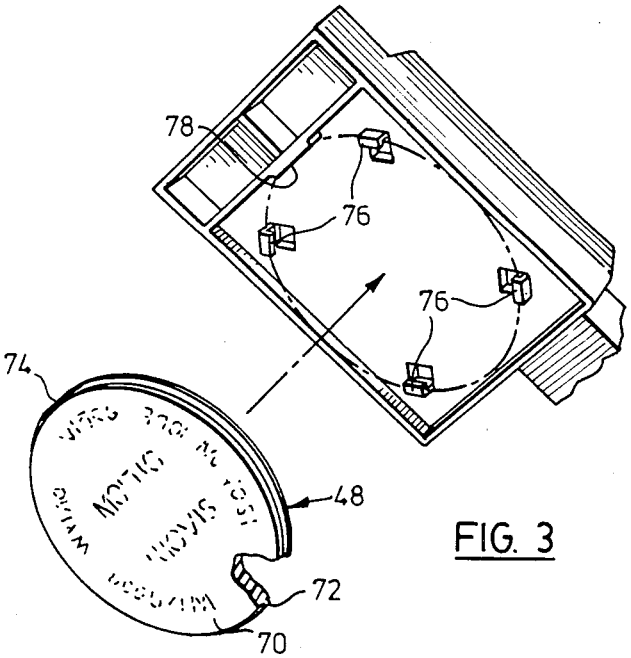
FIG. 3 (drawn adjacent to FIG. 1) is an exploded perspective view of a part of the seal press carrying a die.

Reference is now made to FIGS. 2 and 3 to describe the die 48 and die counter 50. As seen in FIG. 3, the die 48 has a first surface 70 with engraved lettering defining the female portion of the seal set and a central peripheral rib 72 which is interrupted by a flat spot 74 on the edge. This die has a second face (not shown) which can also be used to create a die face. Because the die is premoulded ready to be embossed, it can carry guidelines used to set the die in an engraving machine to ensure proper positioning of the lettering on the die face. Further, the border can be premoulded so that the engraver has only to form the lettering. If required, the opposite side of the die can have a different border arrangement for a different size of embossing. For simplicity, these premoulded markings are omitted from the drawing but it will be appreciated that they can take any form including light source lines crossing at the center for locating the blank die in an engraving machine.

As also seen in FIG. 3 the rib 72 combines with deflectable latches 76 formed in the seal set which also has a shoulder 78 to locate on the flat spot 74 thereby positioning the die angularly.

Turning now to FIG. 2, the die counter 50 is moulded to have the male definition of the embossing and is adhered to the lower portion 46 of the seal set using any suitable two-sided adhesive tape. The die counter 50 is placed on the die 48 in proper registration and then the two-sided tape is placed on the back of the die counter. The seal set is then closed so that the tape will adhere the die counter to the lower portion 46 to complete this sub-assembly. The remainder of the assembly is then completed as will be described with reference to FIGS. 7 to 10.

However before describing these views, more details of the structure of the device will be described with reference to the assembly after first describing their use with reference to FIGS. 4–6. This description will assist in understanding the interrelationship of the parts.

Figure 4:
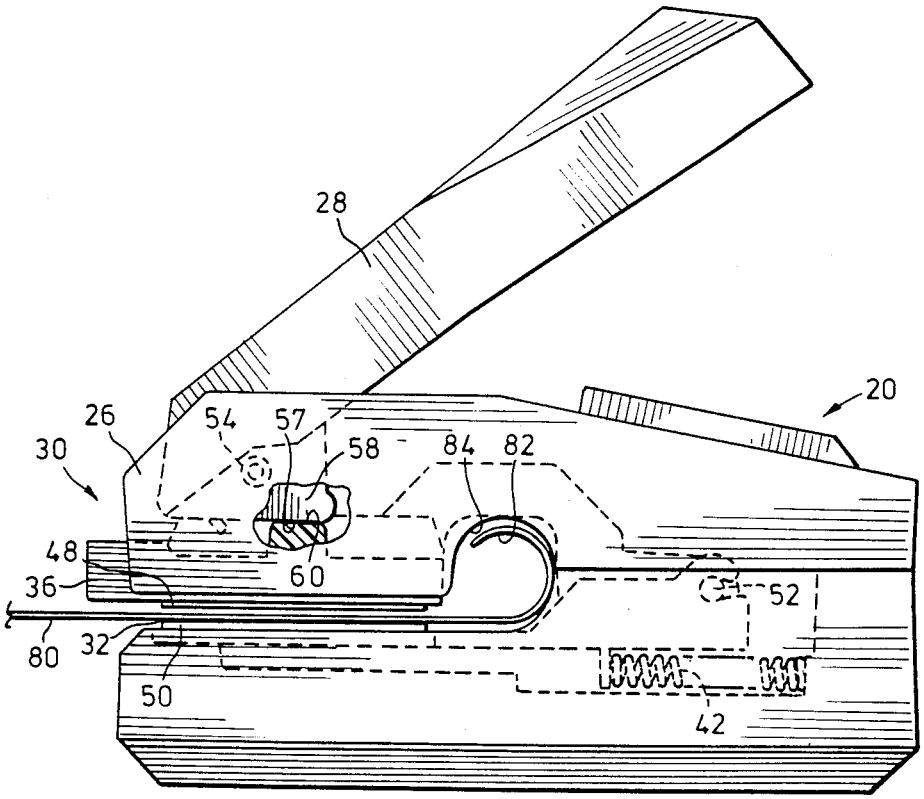
FIG. 4 is a side view of the assembled seal press in the open position about to be used to emboss a piece of paper.

As seen in FIG. 4, the seal press 20 is in position to emboss a piece of paper 80 which has been entered into the slot 32 between the die 48 and the die counter 50. As shown in this view, the embossing can take place almost anywhere on this sheet of paper by rolling excess paper into a curl 82 within a recess 84 provided for the purpose. In this position the seal set front portion 36 projects outwardly of the upper shell 26 and the seal set is in position ready for use. The lever 28 is elevated about the pivot pin 54 and the cam faces 57 of the ribs 58 are in engagement with the respective follower surfaces 60 thereby supporting the handle in the position shown. The biasing spring 42 retains the seal set 30 in this position so that the seal press will remain in this condition ready for use unless collapsed into the storage position shown in FIG. 6 as will be described.

Figure 5:
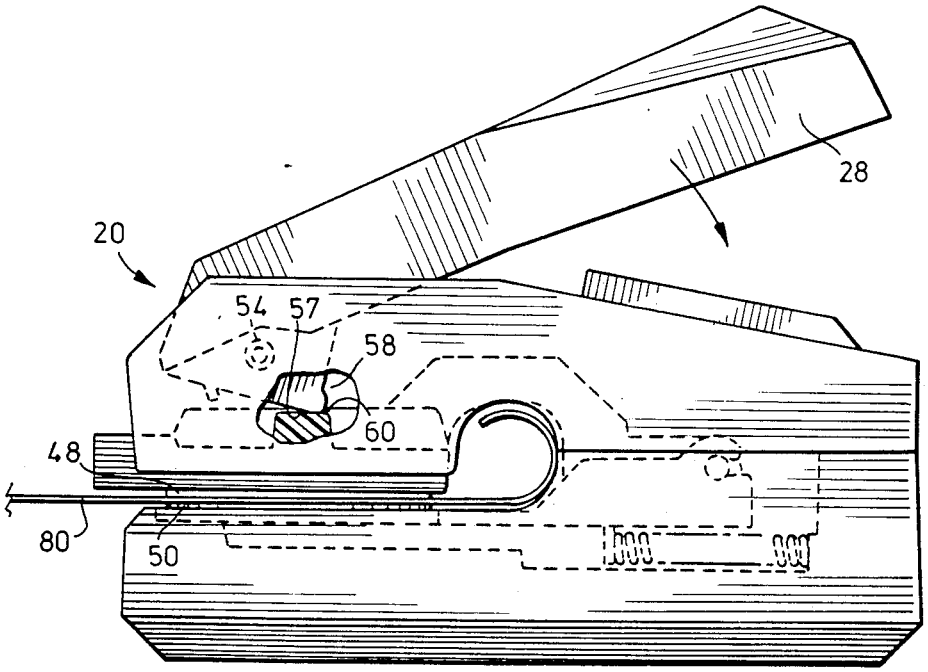
FIG. 5 is a view similar to FIG. 4 and illustrating the movements made to emboss the paper.

Reference is next made to FIG. 5 which illustrates the seal set in use to emboss the paper 80. It will be seen that the lever 28 has been moved angularly downwards about the pivot pin 54 and that this has caused the cam faces 57 on the ribs 58 to press on the follower surfaces 60 and move the die 48 downwardly towards the die counter 50 resulting in an embossing action on the paper 80.

It is difficult to illustrate this embossing action accurately but it is nevertheless evident from FIGS. 4 and 5 what is happening to it. As seen in FIG. 4, the dies are parallel (within the tolerances of manufacture) and the die 48 moves angularly about the pivot 52 of the seal set. Evidently, if the dies are parallel initially, then the forward extremities of the die and counter will meet first because of the arcuate movement of the die 48 about the pivot 52. Because the seal set is of synthetic plastic material having inherent flexibility, continued application of force by the lever 28 cause deflection in the seal set to allow the die and counter to come into firm contact throughout their surface areas. This means that the load needed to cause the embossing is distributed over a small lever movement because the embossing starts at the outer part of the die and continues across the die until the embossing is finished. This results in a reduced load compared with that which would be needed in a conventional die where the die moves along a path normal to the die counter and the force needed is applied across all of the embossing in one motion. It will be evident that this flexibility in the seal set can be allowed because the load is taken by the steel reinforcing elements 38, 40 (FIG. 2) which both extend below the die counter 50 and also support the lever 28.

After the paper has been embossed, the lever is released and the spring 55 (FIG. 2) between the portions of the seal set, causes the upper portion of the seal set to move upwardly carrying with it the lever 28. This is possible because there is a moment about the pivot pin 54 caused by the rearward location of the follower surface 60 relative to the pin 54. Once the lever has moved back into the FIG. 4 position, the paper can be removed and the seal press placed in the closed position shown in FIG. 6. This is achieved by simply applying a force to the front portion 36 of the seal set 30 to compress the spring 42 thereby moving the seal set rearwardly into the position shown in FIG. 6. On reaching this position, the lever is free to fall because the cam surfaces 57 on the ribs 58 are no longer in contact with the follower surfaces 60. Consequently the lever falls into contact with the upper shell 26 and the rearward faces 86 on the outer two of the four ribs 58 engage a forward face 88 of bridges 90 on which are also formed the follower surfaces 60. The compression of spring 42 results in a force which is translated to the bridges 90 and the outer pair of ribs 58 resulting in a turning moment about the pivot pin 54 tending to force the lever 28 into the closed position. Consequently, the lever will remain in this position whether or not the seal press is maintained in a horizontal position.

Figure 6:
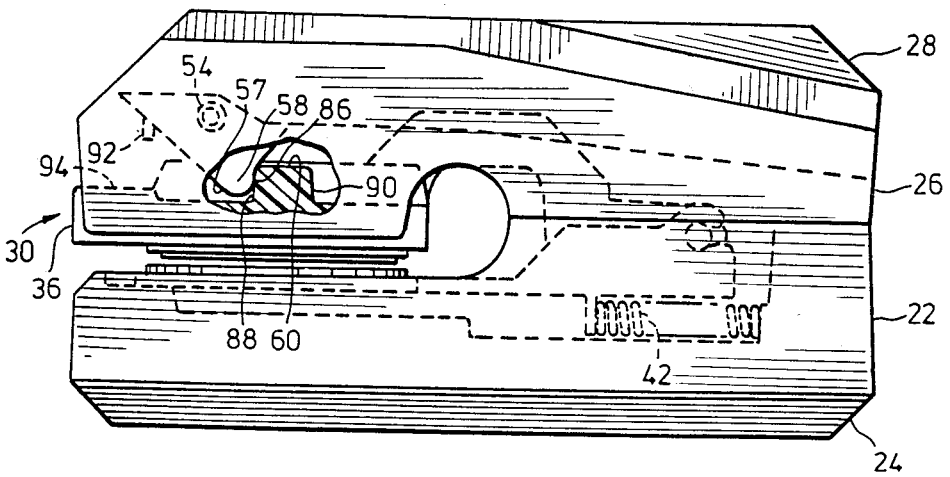
FIG. 6 is a view similar to FIGS. 4 and 5 and showing the seal press in a closed position ready for storage.

When it is desired to open the seal press from the FIG. 6 position into the FIG. 4 position ready for use, the lever 28 is simply elevated and this causes a slight further compression of the spring 42 from the FIG. 6 position. Obviously, the bridge 90 will tend to remain in position behind the ribs 58 and this engagement is released by small projections 92 forward of the pivot pin 54 on the lever 28 which engage surfaces 94 of the upper portion of the seal set to push this portion down at the same time as the lever causes the ribs 58 to move upwards. Consequently the ribs become free of the bridges and at this point the seal set jumps forward, propelled by the energy stored in the compression spring 42. The seal press is then in the position shown in FIG. 4.

Figure 7:
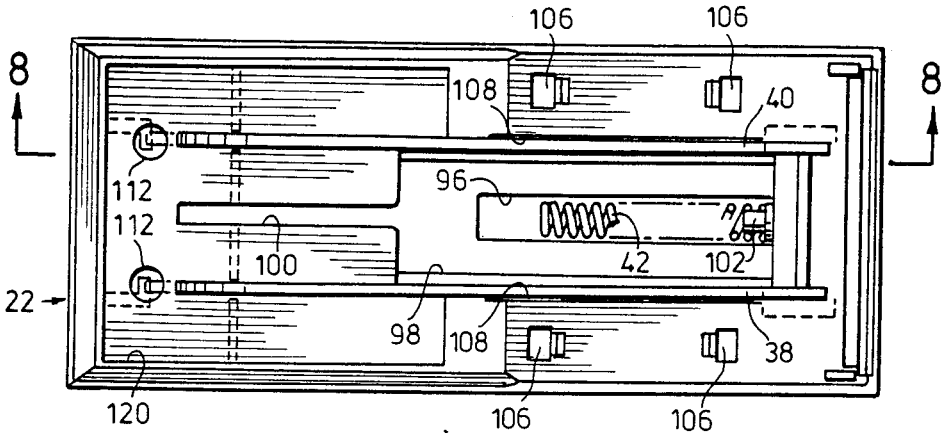
FIG. 7 is a plan view of the lower shell used in the construction of the seal press.

Reference will next be made to FIGS. 7 to 10 as well as to FIG. 2 to describe details of the structure. As seen in FIG. 7, the spring 42 is contained in a recess 96 which is surrounded by a shallower recess 98 having a forward extension 100. The spring 42 sits on a retaining peg 102 and there is space between the forward extremity of the spring and the forward extremity of the recess 96 to receive a tab 104 (FIG. 2) on the under side of the seal set 30. This tab is then in engagement with the spring and a slight bias is created during assembly so that the seal set is affected by a slight forward force.

As seen in FIGS. 2 and 7, suitably shaped openings 106 are provided in the upper surface of the lower shell 22 to receive the hooked pegs 64 (FIG. 2) on the upper shell 26. The openings 106 have lead in ramps to deflect the pegs so that they snap into position for a permanent attachment. The shells are located relative to one another by first engaging the L-shaped elements 66 (FIG. 2) at the rearward extremity of the lower shell 22 in openings formed on the underside of the upper shell 26.

Figure 8:
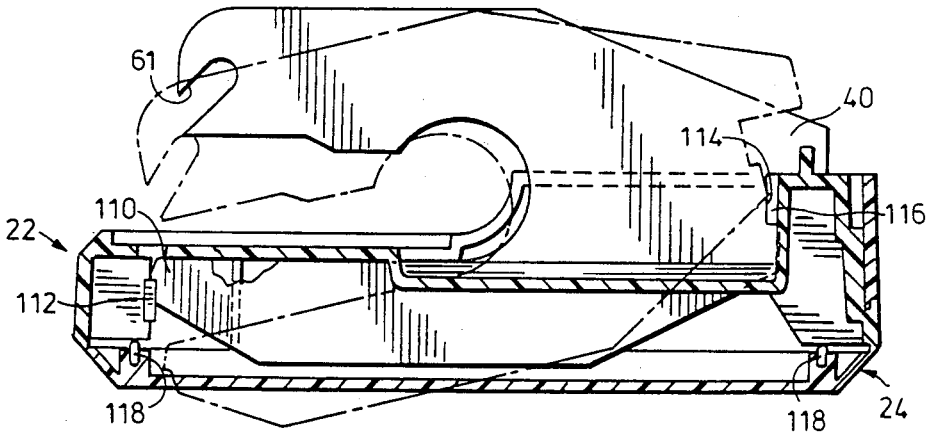
FIG. 8 is a sectional view on line 8—8 of FIG. 7.

Reference is next made to FIG. 8 which illustrates the position of the reinforcing element 40 which is typical also of element 38. As seen in ghost outline, this element is engaged in one of two slots 108 (FIG. 7), in an angled condition and then, by moving the element forwardly and twisting, it can be snapped into position with a nose portion 110 sitting above a tab 112 which can also be seen in FIG. 7. At the same time, a recess 114 adjacent the rearward extremity of the element is snapped about a crosspiece 116 thereby locating the element positively relative to the lower shell 22. Evidently, this procedure must be completed for both reinforcing elements 38, 40 before the base 24 can be attached to the bottom of the lower shell 22. This attachment is completed by engaging small cylindrical pegs 118 in the openings 68 described with reference to FIG. 2. Again this is a snap fit and it is intended to be a permanent attachment.

The subassembly completed as shown in FIG. 8 is then ready to receive seal set 30. This seal set is assembled in the condition shown in FIG. 2 with the die and counter in place and assembled as previously described. With the seal set in a closed condition, the assembler enters it into the assembly shown in FIG. 8 to reach the condition shown in FIG. 9 where the tab 104 is in engagement with the spring 42 and located between the reinforcing elements 38, 40 (FIG. 1) with the lower portion 46 sitting in a recess 120 (FIG. 7) formed in the lower shell and of a length measured front to back which permits the necessary movement of the seal set from the stored position to the position ready for use. The seal set is locked in this position by the compression spring 55 (FIG. 9) which in effect causes engagement of the upper portion 44 with the reinforcing elements 38, 40.

Figure 9:
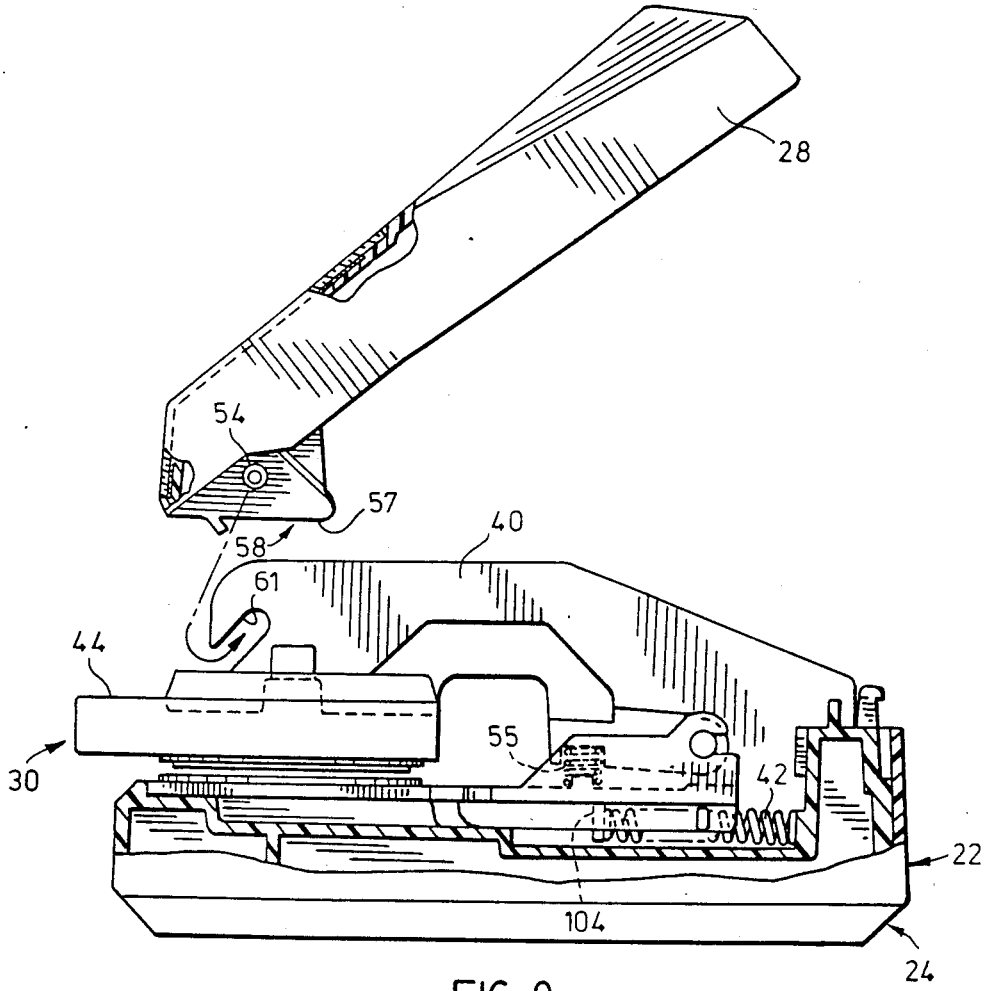
FIG. 9 is a view similar to FIG. 8 and showing the assembly of a seal press and handle.
Figure 10:
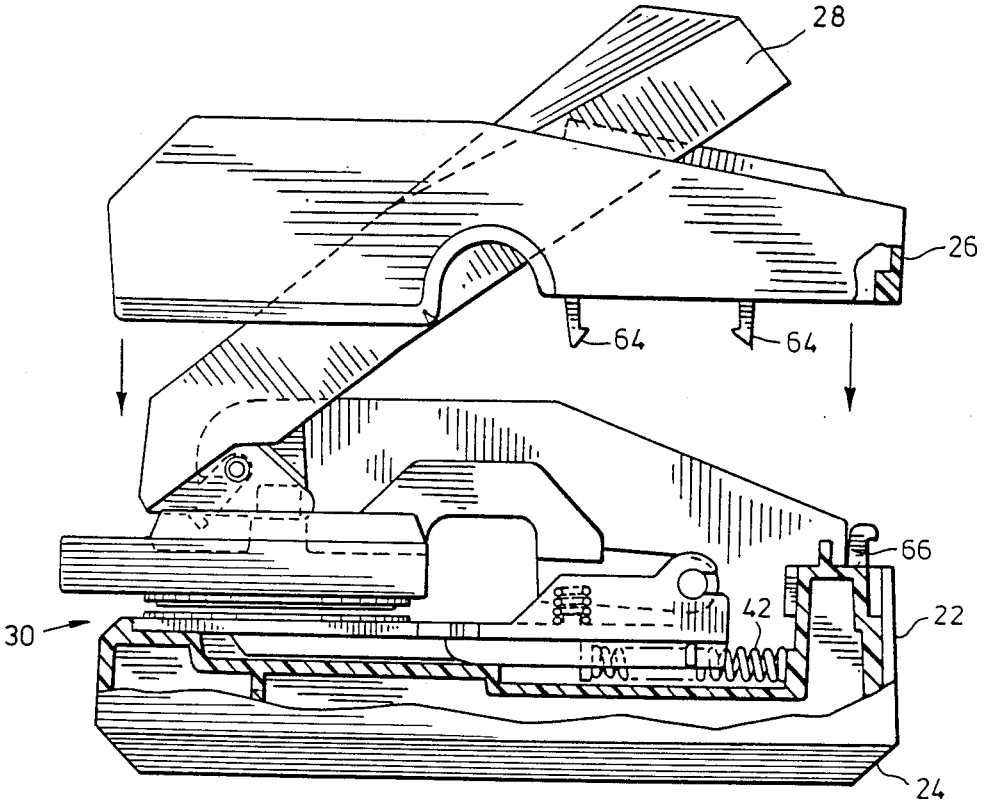
FIG. 10 is a view similar to FIG. 9 and showing the assembly of an upper shell to complete the seal press.

As shown in FIG. 9, the assembly with the seal set 30 in place is now ready to receive the lever 28. The lever is engaged by simply deflecting the seal set and using a tilting action to bring the pivot pin 54 into engagement with the upwardly and rearwardly inclined slots 59, 61 of the reinforcing elements. The elements are then located between pairs of the ribs 58 on the underside of the lever 28. Once the lever is in this position it will be retained there by the compression spring 55 which forces the lever upwardly to the ends of the slots. The assembly is then completed as shown in FIG. 10 by sliding the upper shell over the lever and by bringing the rear end of the upper shell over the L-shaped elements 66 and then rotating the shell downwardly to bring the hooked pegs 64 into engagement in the corresponding openings 106 (FIG. 7) as previously described. The assembly is then ready for use and can be converted into a storage position as previously described by pushing the seal rearwardly against the compression spring 42 so that the lever 28 falls to the stored position shown in FIG. 6.

It will be evident that the components used can be varied within the scope of the invention while permitting use of the desirable features. For instance the die and counter can be of various materials consistent with using the die as part of a mould to form the counter. Similarly the overall shape of the parts and the selection of materials can be changed within the scope of the invention as described and claimed.

We claim:

1. A seal press for use in embossing paper with a desired pattern, the seal press comprising:

a housing;

a seal set including a die, a die counter, means locating the die and die counter relative to one another and pivot means permitting relative movement of the die and die counter to move the seal set between an open position and a closed position to emboss the paper;

retaining means coupling the seal set to the housing and permitting movement of the seal set between storage and operational positions, the die and die counter remaining within the housing as the seal set is moved between the storage and operational positions; and a lever pivotally attached to the housing and having a cam surface engageable with the seal set to move the die about said pivot means when the seal set is in the operational position so that angular movement of the lever will cause movement between the die and die counter to move the seal set into the closed position to emboss the paper, the lever being rendered inoperable by moving the seal set from the operational to the storage position, the seal set then being in the open position.

2. A seal press for use in embossing paper with a desired pattern, the seal press comprising:

a housing having a front and a back;

a seal set coupled to the housing for movement between a first position towards the front of the housing where the seal set is available for use to emboss paper, and a second position within and nearer the back of the housing where the seal set is stored, the seal set including a die, a die counter, and means coupling the die to the die counter for relative movement between the die and die counter to move the seal set between open and closed positions;

a lever having a forward portion attached to the housing for pivotal movement about a transverse axis adjacent the front of the housing, the lever extending rearwardly from the forward portion for hand engagement to move the lever between upper and lower positions, and being in operable engagement with the seal set in said first position to move the seal set from the open to the closed position upon moving the lever downwardly towards the lower position;

biasing means urging the seal set towards the first position to retain the seal set in the first position ready to receive paper for embossing; and retaining means for releasably holding the seal set in the second position to store the seal set, the lever than being released from operable engagement with the seal set so that the lever is free to fall into the lower position, the lever being retained in the lower position by engagement of the seal set with the handle under the influence of said biasing means for storage of the seal press.

3. A seal press for use in embossing paper with a desired pattern, the seal press comprising:

a housing;

a seal set coupled to the housing for movement between inner and outer positions with the housing and including means biasing the seal set into an open position to receive the paper;

a lever pivotally connected to the housing and movable between upper and lower positions;

first engagement means between the lever and seal set with the lever and seal set in respective upper and outer positions to permit operation of the lever to close the seal set and emboss the paper;

second engagement means between the lever and the seal set with the lever and seal set in respective lower and inner positions for storage of the seal press; and means biasing the seal set towards the outer position and into engagement with second engagement means to retain the lever in the lower position.

4. A seal set for use in a seal press, the seal set comprising: first and second portions; a die and a die counter coupled respectively to the first and second portions; means to minimize the effort required to perform an embossing operation with the die and die counter comprising a hinge coupling the first and second portions to one another, said portions holding said die and die counter parallel to one another when the die and die counter are spaced apart only to the extent required to insert material to be embossed between the die and die counter, and at least one of the first and second portions being sufficiently flexible to accommodate rotation of at least one of the die and die counter sufficient to permit the die and die counter to deviate from said parallel relationship as they are closed to perform an embossing operation so that embossing starts at the outer part of the die and continues across the die until the embossing is completed.

* * * * *